United States Patent [19]

Kosrow et al.

[11] Patent Number: 4,526,115

[45] Date of Patent: Jul. 2, 1985

[54] AUTOMATIC SLEEVE MAKING

[75] Inventors: Robert L. Kosrow, Hoffman Estates; Chieh-Kung Yin, Hawthorn Woods, both of Ill.

[73] Assignee: Union Special Corporation, Chicago, Ill.

[21] Appl. No.: 505,671

[22] Filed: Jun. 20, 1983

[51] Int. Cl.[3] ..... D05B 97/00; D05B 21/00; D05B 35/00; D05B 27/00

[52] U.S. Cl. ..... 112/262.3; 112/121.12; 112/121.15; 112/141; 112/147; 112/304

[58] Field of Search ..... 112/262.3, 121.11, 121.12, 112/121.15, 262.1, 262.2, 141, 147, 303, 304, 308, 309, 121.29

[56] References Cited

U.S. PATENT DOCUMENTS

| | | | |
|---|---|---|---|
| 3,640,235 | 2/1972 | Burton | 112/147 X |
| 3,954,071 | 5/1976 | Mall et al. | 112/153 X |
| 3,980,032 | 9/1976 | Kleinschmidt et al. | 112/121.11 X |
| 4,428,315 | 1/1984 | Keeton | 112/147 X |

*Primary Examiner*—Peter Nerbun
*Attorney, Agent, or Firm*—John W. Harbst; John A. Schaerli

[57] ABSTRACT

A method and apparatus are provided for acting upon a cloth in a manner for automatically forming a shirt sleeve from a sleeve blank. The blank is conveyed by a conveyor is a first direction and a hem is automatically formed and secured along a longitudinal edge thereof. The blank is automatically picked up off the conveyor and folded about an axis substantially transverse to the first direction. The transference of the hemmed and folded sleeve is controlled such that the overlapping edges of the folded blank are in substantial alignment relative to one another when deposited on a second conveyor which conveys the blank in a second direction. As the blank is conveyed by the second conveyor, the overlapping and generally aligned edges of the folded workpiece are secured together to form a shirt sleeve.

11 Claims, 11 Drawing Figures

AUTOMATIC SLEEVE MAKING

FIELD OF THE INVENTION

The present invention concerns sewing machines and, more particularly, an automatic sewing apparatus capable of producing shirt sleeves from a sleeve blank.

BACKGROUND OF THE INVENTION

The present invention is a distinctive improvement over that sewing system shown in U.S. patent application, Ser. No. 319,671 filed Nov. 9, 1981, now U.S. Pat. No. 4,428,315.

Like the present invention, the above-identified application discloses a method and apparatus for automatically forming a shirt sleeve from a sleeve blank. One of the most important and demanding steps in the disclosed automated system concerns the transference of the workpiece from one conveyor to another. To assure proper sleeve formation after transference, the overlapping edges of the workpiece should be substantially aligned. If the edges are not substantially aligned, any or all of the following problems may result. First, the seaming of the edges may not properly be effected. Alternatively, if the overlapping edges of the folded blank are not properly aligned the resultant mismatched product could present severe problems on subsequent insertion operations. Moreover, if the edges of the folded over blank are not properly aligned, the resultant sleeve size may alter considerably from that which is desired.

The apparatus disclosed in the above-identified application does not provide adequate measures whereby those problems are obviated. Instead, the disclosed automatic apparatus utilizes a single sensor for controlling the pick up head as a function of the initial advancing edge detection. The mere detection of the leading edge will not, however, serve to avoid the problems.

A preset sensor assumes that neither the workpiece size nor the advancement rate of the workpiece will vary during sewing. As a skilled artesian may well appreciate, however, such assumptions are unfounded. Workpiece sizes may vary considerably in length. Moreover, the advance rate of the workpiece may also be readily changed to enhance production schedules. In short, the provision of a single edge detection system for activating the pick up arm to effect workpiece transference will not assure that the workpiece will be folded in half. Accordingly, mismatching of the overlapping edges may well result.

BRIEF DESCRIPTION OF THE PRESENT INVENTION

Because of the above and in accordance with the present invention, there is provided an improved mechanism which is capable of forming T-shirt sleeves from sleeve blanks. According to the present invention, a method and apparatus are provided that would eliminate drawbacks inherent with the above described sleeve production method.

A method of automatically forming a shirt sleeve from a sleeve blank is provided. The method includes the steps of sequentially: (a) conveying the blank in a first direction such that a hem may be formed along the longitudinal edge thereof; (b) securing the hem in the workpiece; (c) automatically picking up the hem sleeve blank and folding it about an axis substantially transverse to and halfway along the hemmed edge; (d) conveying the folded and hemmed blank in a second direction whereby securing aligned and overlapped edges of the folded workpiece to form a shirt sleeve. Between steps (b) and (c) a very important step is further conducted. Between steps (b) and (c) calculation of the workpiece size is conducted. Based on this calculation, the pick up arm is activated to assure that the workpiece will be folded in half in a manner such that the overlapping edges will be substantially aligned when the workpiece is deposited on the second conveyor means.

The invention also comprises apparatus for practicing the method described above. The assembly includes a first material conveyance means disposed for conveying the workpiece along an extended horizontal path in a first direction. A first sewing machine disclosed adjacent the first conveying means for treating the hemmed edge of the workpiece. A second material conveyance means disposed at the end of said first conveyance means for transporting the workpiece along an elongated horizontal path in a second direction extending away from said first conveyance means. A second sewing machine arranged adjacent the second conveyance means for treating a second edge of the workpiece being presented thereto. A pick up and transfer mechanism including a movable pick up head is arranged at the interface between the first and second conveyance means. A further component of this system includes means for calculating the individual length of the workpiece being sewn, and means responsive to said calculation means for computing the activation of said pick up and transfer mechanism. By electronically processing this length data, the pick up arm may be activated such that it folds the workpiece in half whereby enhancing the probability that the overlapping edges of the folded workpiece are arranged in substantial alignment relative to one another.

In line with the above, a primary object of the present invention is to provide a method and apparatus for automatically forming T-shirt sleeves from sleeve blanks. This and other objects of the invention will become clear from the inspection of the detailed description of the invention and from the appended claims.

BRIEF DESCRIPTION OF THE DRAWINGS

Having in mind the above objects and other attendent advantages that would be evident from an understanding of this disclosure, the invention comprises the devices, combinations, and arrangement of parts as illustrated in the presently preferred form of the invention which is hereinafter set forth in detail to enable those skilled in the art to readily understand the function, operation, construction and advantages of same when read on conjunction with the accompanying drawings in which.

Figure 3:
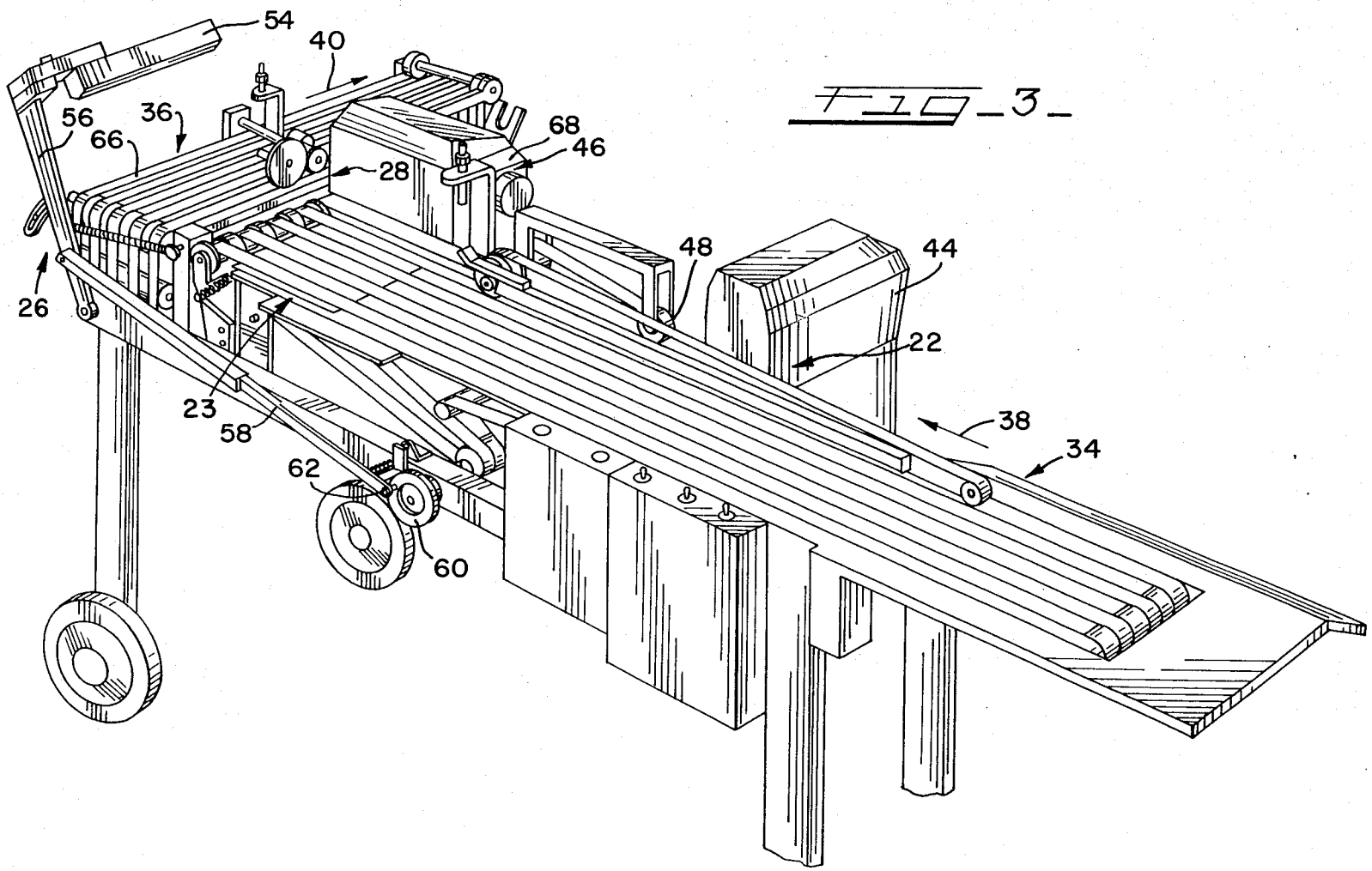
Figure 4:
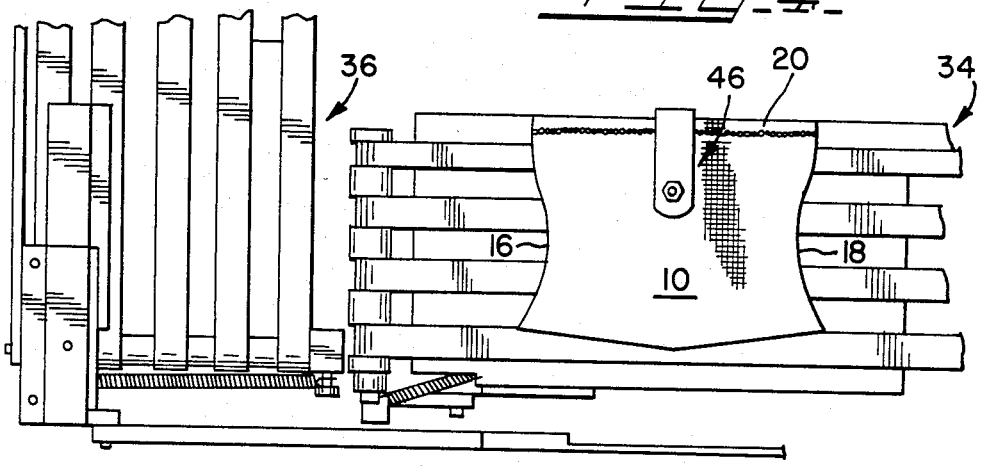
Figure 5:
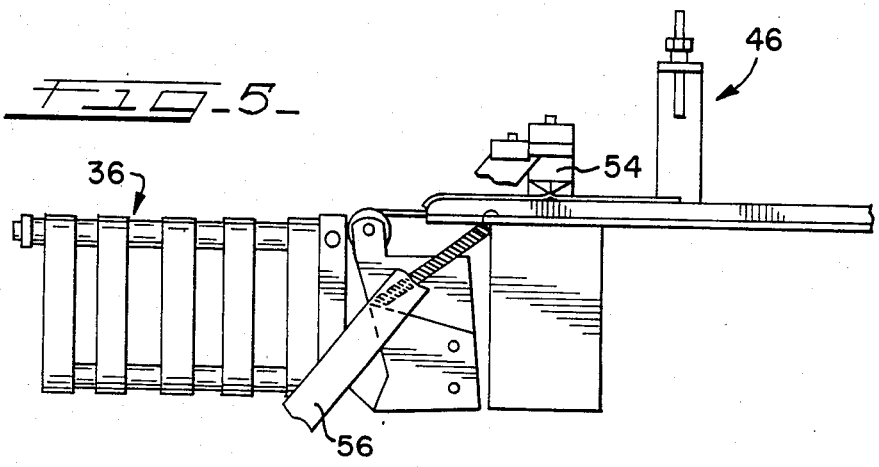
Figure 6:
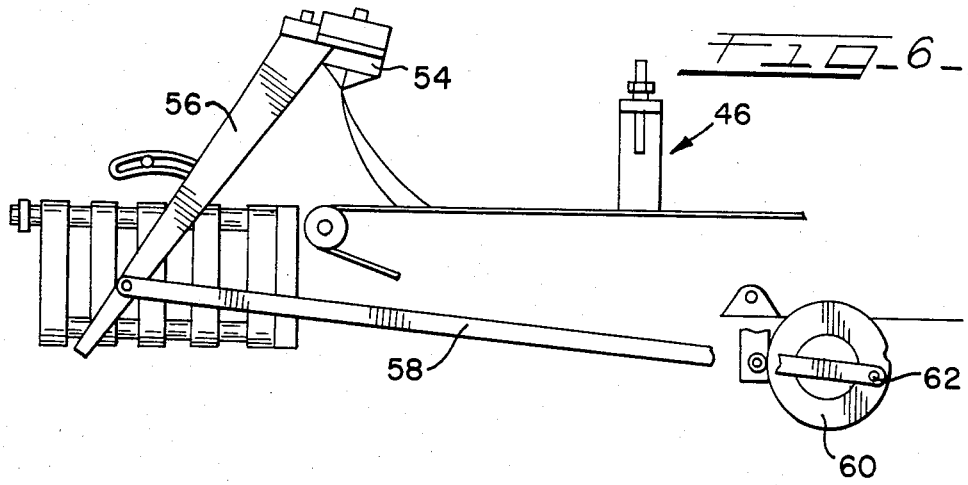
Figure 7:
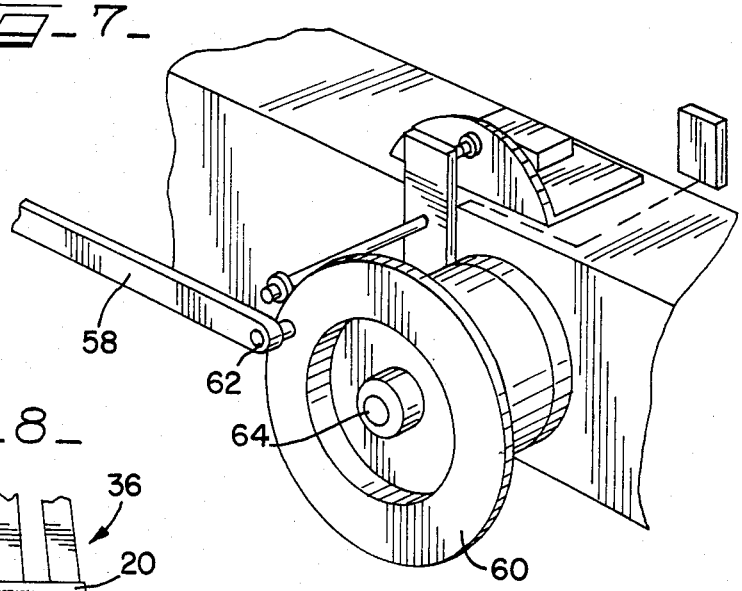
Figure 8:
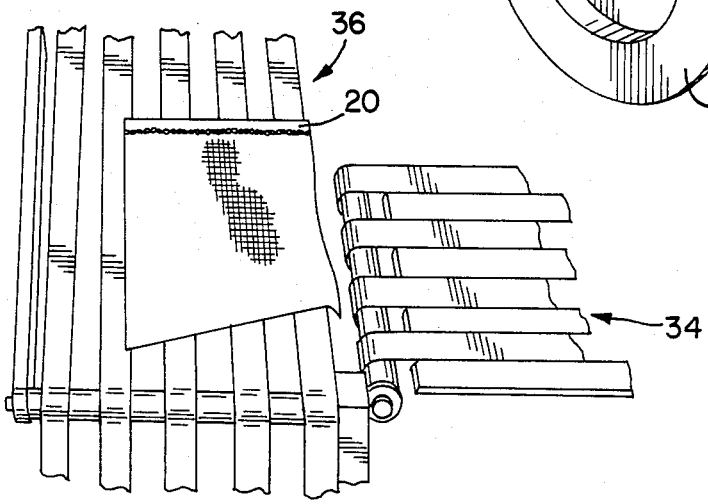
Figure 9:
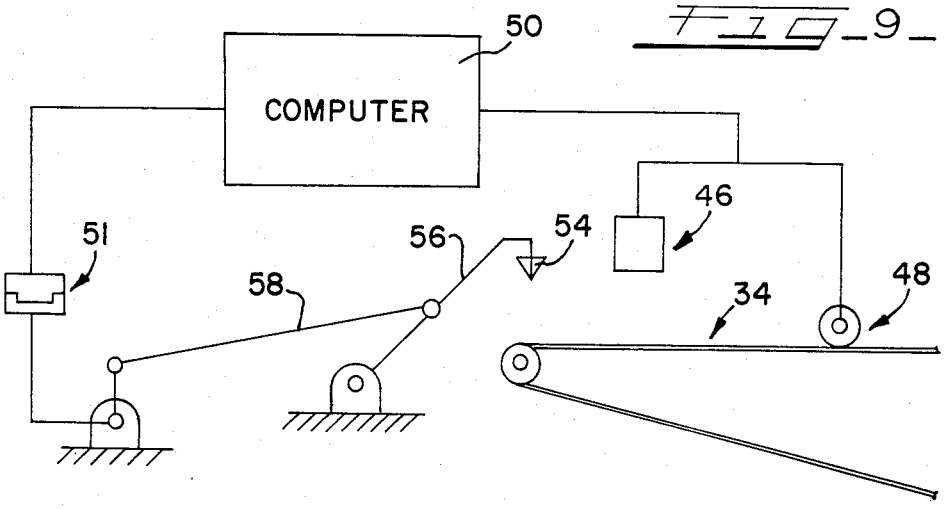

FIGS. *2a*, *2b*, and *2c* are, respectively, top views of a sleeve blank, hemmed blank, and finished sleeve;

FIG. 3 is a perspective view of an exemplary apparatus for automatically forming shirt sleeves according to the present invention;

FIG. 4 is a top plan view showing the first conveyance means of the apparatus shown in FIG. 3 as the workpiece blank approaches the pick up point;

FIG. 5 is a side view showing the first conveyance means of FIG. 3 with the pick up and transferring mechanism initially removing a workpiece blank from the conveyor;

FIG. 6 is a side schematic view showing the pick up head assembly as it simultaneously transfers and folds the workpiece blank;

FIG. 7 is a detailed perspective view of the pick up and transfer mechanism drive components;

FIG. 8 is a top perspective view illustrating the transportation of a hemmed and folded sleeve blank along the second conveyance means;

FIG. 9 is a schematic illustration of the means for controlling the pick up arm, pick up and transferring mechanism.

DETAILED DESCRIPTION OF THE PRESENT INVENTION

Figure 1:
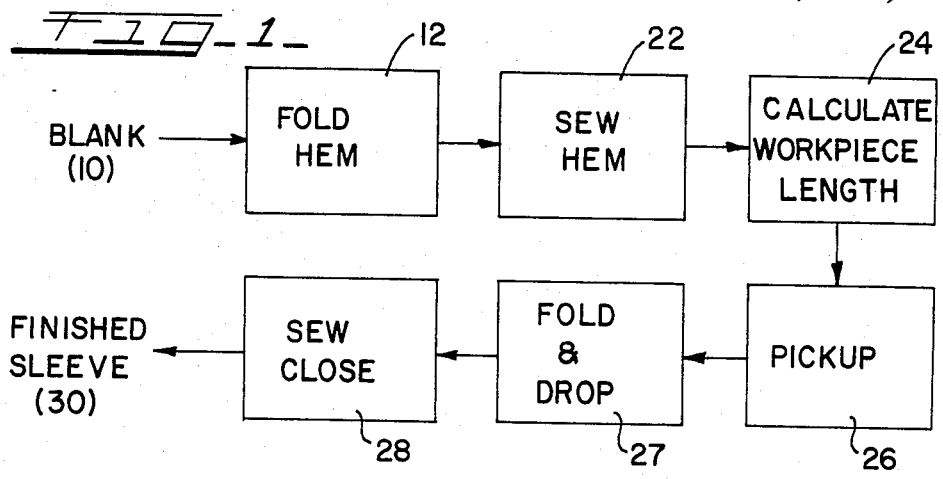
FIG. 1 is a schematic illustrating various stages in the production of shirt sleeves according to the present invention.
Figure 2A:
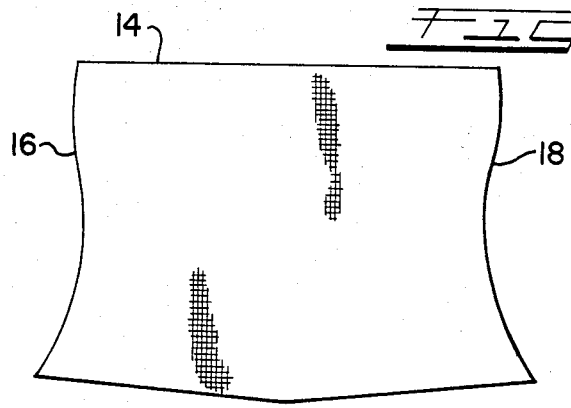
Figure 2B:
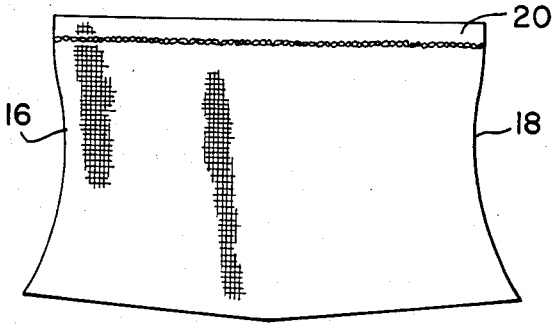
Figure 2C:
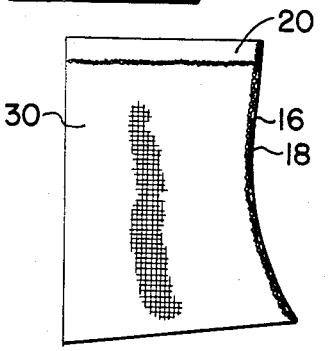

FIGS. 1 and 2 schematically illustrate the general practice of the present invention to form shirt sleeves from sleeve blanks, particularly T-shirt sleeves. The blank or fabric piece 10 is fed to a forming station 12 in an orientation similar to that shown in FIG. 2*a*. That is, the blank 10 is arranged with its longitudinal edge 14 extending substantially parallel with the direction of workpiece advancement and having its leading and trailing edge 16 and 18, respectively, extending generally transverse to the direction of workpiece advancement. As illustrated in FIG. 2*b*, a hem 20 is provided in the marginal or longitudinal edge of the workpiece at the forming station 12 (FIG. 1). The hem 20 is subsequently secured in the workpiece at a first sewing station 22. The hemmed blank is transported by a conveyor to a pick up station 26. During its advancement to the pick up station, the length of the advancing workpiece is calculated as at 24 in FIG. 1. The length data is then processed to control a pick up and transfer mechanism 26 to pick up the workpiece and fold it along an axis extending substantially transverse to and halfway along the hemmed edge 20. The transfer mechanism carries the hemmed and folded workpiece over a second conveyor whereat the workpiece is released at station 27. The orientation of the folded and hemmed workpiece at station 27 is such that the leading and trailing edges overlap and are substantially aligned relative to one another. The second conveyance means serves to move the workpiece toward a second sewing station 28 such that the overlapping and generally aligned leading and trailing edges may be secured together. Ultimately, a finished sleeve illustrated by reference numeral 30 in FIG. 2*c* emerges from the sewing system.

The details of an exemplary apparatus for practicing the method described above is illustrated in FIGS. 3 through 9. The presently preferred form of the invention includes a pair of endless multibelt conveyors 34 and 36 arranged in a generally L-shaped formation. The conveyor systems may be moved at the same speeds in the directions of arrows 38 and 40, respectively, by common motor drive means. Arranged adjacent one leg of the first material conveyance means is a first automatic sewing machine 44 defining the first sewing station 22. The sewing machine may be of any conventional overedge type such as a UNION SPECIAL "Mark IV." On its way toward the machine 44, the longitudinal edge of the workpiece passes through a hemmer which forms a fold in the edge. The fold is subsequently treated or secured by the action of the first automatic sewing machine.

The workpiece length is thereafter calculated on its way to the pick up station or position 23. Although alternative means and methods may be available, in the preferred form of the apparatus, the workpiece length is calculated in the following manner. First, the length of the workpiece is measured. Second, and because the speed of the conveyor means may vary, the advance rate of the workpiece is measured. The preferred means for measuring the length of the workpiece includes a photosensor assembly 46 or other automatic sensor means. The sensor 46 is capable of producing a signal in response to the interruption and restoration of light. The photosensor assembly is arranged to detect the passage of the leading and trailing ends 16 and 18, respectively of the workpiece. The means for measuring the rate of workpiece advancement preferably includes a sensor means, generally indicated as 48. The sensor means 48 records the feed rate of the conveyor system and thus the workpiece. As schematically shown in FIG. 9, the outputs of the optical sensor assembly 46 and the means for measuring the advance rate of the workpiece 48 are delivered to a controller or computer 50 whereat they are electronically processed. Ultimately, the computer controls the actuation of the pick up arm as will be described.

Having once reached the pick up station 24, the pick up and transfer mechanism 26, disposed at the intersection of the two conveyor systems, is actuated. The pick and transfer mechanism preferably is of the type disclosed in Ser. No. 283,977 filed July 16, 1981, now U.S. Pat. No. 4,444,384, the full disclosure of which is incorporated herein by reference. Such mechanism includes a cloth engaging head portion 54 which actually clamps on to the workpiece blank 10, a lever 56 mounting the head 54 for pivotal movement about a horizontal axis perpendicular to the direction of workpiece advancement, a link 58 for effecting movement of the lever 56 and a rotating disk 60 to which the length 58 is mounted by a pivotal connection 62 (see FIG. 7). The pivotal connection 62 is offset with respect to the disk 60 and the disk 60 is connected by a magnetic clutch to a drive shaft 64. The magnetic clutch 51 which is conventional, is timely activated by the computer or controller 50. By controlling the actuation of the transfer assembly in the above described manner, the pick up head engages the workpiece along an axis substantially transverse to and halfway along the hemmed edge. In this manner, when the pick up arm is raised as shown in FIG. 6, the workpiece folds upon itself with the leading and trailing edges of the fabric piece being arranged and an overlapping in substantially aligned relationship relative to one another.

When the transfer apparatus has moved a predetermined acurate distance, the folded and hemmed workpiece is released from the head portion and is deposited on the second material conveyance means 36 as shown in FIG. 8. The second conveyance means 36 moves the folded and hemmed blank in a second direction extending generally transverse to its first direction.

Mounted adjacent the second leg 66 of the L-shaped conveyor formation, is a second automatic sewing machine 68 defining the second sewing station 28. Like machine 44, the sewing machine 68 may be of any conventional type such as a UNION SPECIAL "Mark IV." The second automatic machine serves to secure together the overlap edge portions of the folded over blank as it moves in its second direction. FIG. 2*c* shows a typical completed T-shirt sleeve as it emerges from the second sewing station 28.

An exemplary operative procedure according to the invention will now be described. A sleeve blank 10 is placed on the first conveyance means 34 with its longitudinal edge substantially parallel with the first direction of conveyance. The conveyor moves the blank and a hem in formed in the marginal or longitudinal edge thereof. The hem is subsequently secured at the first sewing station 22 by the sewing pick up position 23, the length thereof is calculated. The length data is then electronically processed to control the operation of the pick up and transfer mechanism. Although multiple variations are achievable, in the preferred embodiment and as a result of the electronic processing, the calculated length of the workpiece is divided by two such that the transfer mechanism engages the workpiece along measurement data, the transfer mechanism engages the workpiece along an axis extending substantially transverse to and halfway along the hemmed longitudinal edge. The upward movement of the pick up head causes the workpiece to fold over with the leading and trailing edges in an overlapped substantially aligned relationship. Once the pick up head has moved a predetermined distance, the folded and hemmed blank is freed from the pick up head portion 54 and is deposited on the second conveyor system 36. In such position, the overlapping and generally aligned leading and trailing edges of the workpiece blank extend generally parallel to the advancement direction of the second conveyor means.

The second conveyor means transports the folded and hemmed blank toward the second sewing station 28 defined by the automatic sewing machine 68. At the second sewing station, the aligned and overlapped edges of the folded workpiece are secured together whereby forming a completed sleeve section.

Thus there has been provided, in accordance with the invention, a method and apparatus for AUTOMATIC SLEEVE MAKING that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described our invention, what we claim is:

1. A method for automatically forming a shirt sleeve from a sleeve blank comprising the steps of:

advancing the sleeve blank in a first direction;

automatically forming a hem along a first edge of said blank;

securing the hem in the marginal edge of the workpiece;

calculating the length of the advancing sleeve blank and developing length data as a result thereof;

processing the length data to allow a pick up and transfer means to fold the workpiece in half upon itself;

advancing the folded and hemmed sleeve blank in a second direction substantially transverse to said first direction; and automatically securing together overlapped edges of the folded over blank to form a shirt sleeve.

2. A system for automatically forming a sleeve portion of a garment from a workpiece blank, comprising:

a first endless conveyor means adapted to advance said blank along a first direction to a pick-up position;

a first sewing machine arranged ahead of said pick-up position in the direction of workpiece advancement and adjacent said first endless conveyor means for securing a hem along a first edge of the workpiece blank;

means for automatically picking up the hemmed blank off the first conveyor means and folding it along an axis extending substantially transverse to and half way along the hemmed edge;

means for controlling the pick-up means as a function of the length of the blank being sewn, said length having been calculated;

a second endless conveyor means for transporting the folded and hemmed blank from said pick-up means in a second direction extending generally transverse to said first direction; and a second sewing machine for securing together overlapped portions of said folded over blank as it moves in said second direction.

3. The system according to claim 2 wherein said control means includes first means for measuring the individual lengths of the workpieces being sewn, second means for measuring the speed of said first conveyor means, and means responsive to said first and second measuring means for computing the actuation of said pick-up means.

4. The system according to claim 3 wherein said first measuring means includes a means responsive to the interruption and restoration of light.

5. The invention according to claim 3 wherein said first measuring means includes a photosensor arrangement for detecting the leading and trailing edge of the workpiece blank.

6. The invention according to claim 3 wherein said second measuring means includes a speed sensor.

7. The invention according to claim 3 wherein said means responsive includes a controller means capable of producing an output signal for controlling the pick-up arm.

8. An automatic system for forming a sleeve portion of a garment from a workpiece blank, comprising:

first and second endless belt conveyor systems arranged in an approximately L-shaped path for receiving and moving the workpiece blanks in sequence;

a first edge treating means positioned adjacent one leg of the L-shaped path and adapted to secure a hem in the marginal edge of the workpiece blank;

a pick up and transfer mechanism disposed at the intersection of said first and second endless belt conveyor systems for folding the workpiece blank during its movement to the second conveyor system, said pick up and transfer mechanism includes means for calculating the length of the workpiece and for operating said pick up and transfer mechanism as a function of the calculated length of the individual workpiece blank being treated; and a second edge treating means positioned adjacent the other leg of the L-shaped path and adapted to secure together overlapped portions of said folded over workpiece blank as it is moved by said second conveyor system.

9. Automatic apparatus for making a shirt sleeve from a fabric piece, comprising:

first material conveyance means for individually conveying the fabric pieces in succession along an elongated material path, said fabric piece being so arranged on the conveyance means such that its leading and trailing edges extend generally transverse to the direction of workpiece advancement;

a first sewing machine arranged adjacent said first material conveyance means and adapted to secure a hem in one longitudinal edge of the fabric piece;

means for calculating the length of the individual fabric pieces being advanced and for processing length data developed as a result of said calculations to position the fabric pieces on a second material conveyance means in a folded relationship with the leading and trailing edges of the fabric piece being arranged in an overlapping and substantially aligned relationship relative one another;

a second material conveyance means for transporting the hemmed and folded over fabric pieces along another elongated material path; and a second sewing machine arranged adjacent said second material conveyance means for automatically stitching together the overlapping edges of said folded over fabric workpiece as it is being moved by said second material conveyance means.

10. A method for automatically forming a shirt sleeve from a sleeve blank comprising the steps of:

advancing the sleeve blank in a first direction;

automatically forming a hem along a first edge of said blank;

securing the hem in the marginal edge of the workpiece;

calculating the length of the advancing sleeve blank and developing length data as a result thereof; and processing the length data to allow a pick up and transfer mechanism to fold the workpiece in half upon itself.

11. A system for automatically forming a sleeve portion of a garment from a workpiece blank, comprising:

a first endless conveyor means adapted to advance said blank along a first direction to a pick-up position;

a first sewing machine arranged ahead of said pick-up position in the direction of workpiece advancement and adjacent said first endless conveyor means for securing a hem along a first edge of the workpiece blank;

means for automatically picking up the hemmed blank off the first conveyor means and folding it along an axis extending substantially transverse to and half way along the hemmed edge; and means for controlling the pick-up means as a function of the length of the blank being sewn, said length having been calculated.

* * * * *